US005549457A

United States Patent [19]

Flores et al.

[11] Patent Number: 5,549,457

[45] Date of Patent: Aug. 27, 1996

[54] PAVEMENT SPRAYER HAVING MOVABLE SPRAY GUARD

[75] Inventors: Abel G. Flores, Monterey Park; Gerald R. Marriott, Glendora; Jose J. Castillo, Commerce, all of Calif.

[73] Assignee: Manhole Adjucting Contractors Inc., Monterey Park, Calif.

[21] Appl. No.: 410,926

[22] Filed: Mar. 27, 1995

[51] Int. Cl.[6] ..... E01C 19/17

[52] U.S. Cl. ..... 404/84.05; 404/111

[58] Field of Search ..... 404/84.05, 111

[56] References Cited

U.S. PATENT DOCUMENTS

| | | | |
|---|---|---|---|
| 2,657,092 | 10/1953 | Jones | 404/111 X |
| 3,120,927 | 2/1964 | Holland | 404/111 X |
| 3,284,006 | 11/1966 | Cartwright . | |
| 3,891,585 | 6/1975 | McDonald . | |
| 4,069,182 | 1/1978 | McDonald . | |
| 5,297,893 | 3/1994 | Corcoran et al. . | |

FOREIGN PATENT DOCUMENTS

| | | | |
|---|---|---|---|
| 2643924 | 9/1990 | France | 404/84.05 |

*Primary Examiner*—William P. Neuder

*Attorney, Agent, or Firm*—Darby & Darby, P.C.

[57] ABSTRACT

A pavement sprayer has at least one portion of its sprayer mechanism which is movable between an operative position and a retracted, inoperative position. At least one blocking member is mounted to the sprayer mechanism for movement between a blocking position, in which any spray emanating from the movable portion is at least partially blocked, and a nonblocking position, in which spray emanating from the movable portion is not blocked. The blocking member moves between its blocking and nonblocking positions in response to movement of the sprayer mechanism between the operative and retracted positions. In a preferred embodiment, at least one device senses the position of the movable portion and causes the blocking actuator to place the blocking member in the blocking position whenever the movable portion of the sprayer mechanism is in its retracted, inoperative position.

22 Claims, 3 Drawing Sheets

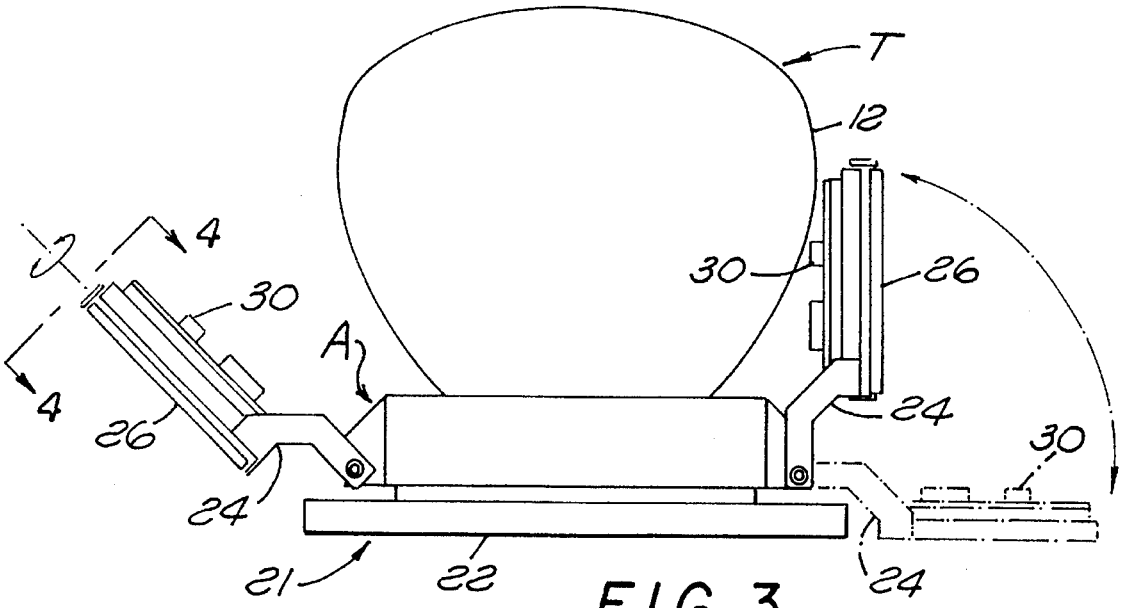
FIG. 3
FIG. 4
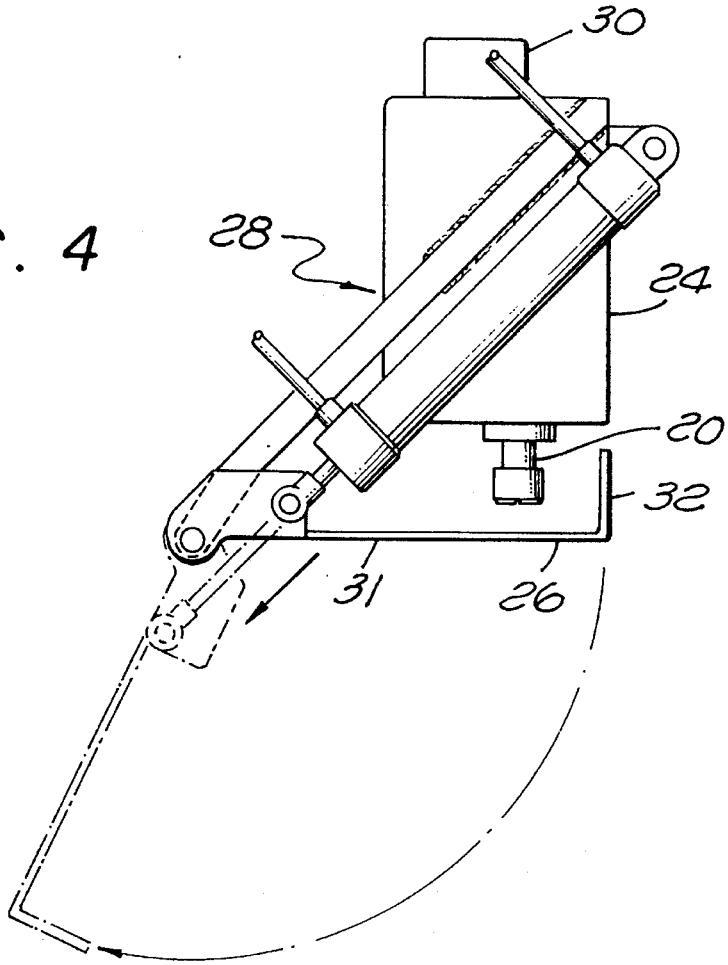

PAVEMENT SPRAYER HAVING MOVABLE SPRAY GUARD

BACKGROUND OF THE INVENTION

The present invention relates to pavement sprayers and, more specifically, to movable guards for preventing the accidental spraying of liquid paving compositions.

Roads, parking lots and a variety of other surfaces are often paved or coated by spraying liquid asphalt materials onto a pavement surface at elevated temperatures. As described in U.S. Pat. Nos. 3,891,585, 4,069,182 and 5,297,893, the specifications of which are incorporated herein by reference, one such method involves heating an asphalt-rubber mixture to approximately 400° F. for a time sufficient to form a jellied composition and spraying the composition onto a surface to be paved.

Commercial systems for the spray application of asphalt compositions are well known in the art. They typically consist of a truck equipped with a tank for carrying the composition and maintaining it at an elevated temperature, a pump for pressurizing the composition, and hoses for transporting the heated and pressurized composition to a series of spray nozzles. The nozzles are mounted to a distributor bar on the rear of the truck and are positioned on the bar to spray the asphalt mixture onto the ground in a preselected pattern as the truck moves.

Because the width of the required spray pattern can vary between jobs, systems for the spray application of asphalt pavement materials often use a combination of distributor bar segments which together exceed the width of the truck and are separately controlled by an operator. In one common configuration, a stationary "main" portion of the distributor bar extends substantially across the width of the truck. A pair of "secondary" outer portions are then mounted to the ends of the main portion so that in an operative position they line up with it. This enables wide strips of pavement to be sprayed by supplying liquid to all portions of the bar, and narrower strips to be sprayed by interrupting the flow to one or more of the outer portions.

The outer portions of the distributor bar are typically mounted to the truck for upward pivotal movement from a horizontal operative position to a substantially vertical retracted position. This reduces the effective width of the truck as it travels between jobs or is used to spray narrower strips of pavement. Unfortunately, however, the nozzles on the outer portions of the bar face outwardly from the truck in the retracted position. In order to avoid harm to bystanders or nearby property, it is important to cut off the flow of paving material to the outer portions when they are in their retracted positions.

Prior distributor trucks sometimes use mercury switches and pneumatic valves to stop the flow of liquid to outer portions of the bar when the outer portions are in their retracted positions. Each mercury switch is oriented to close its contacts only when an associated portion of the bar is in its operative position. The switch acts through a pneumatic actuator to operate one or more fluid valves controlling the flow of heated pavement material to a plurality of nozzles of the bar. When the contacts close, the valves allow liquid to flow to the nozzles on a given outer portion of the distributor bar. Conversely, the contacts open when the outer portion moves to its retracted (vertical) position, deenergizing the pneumatic actuator and the fluid valve. This closes the fluid valve, preventing liquid from being sprayed from the affected nozzles.

Unfortunately, mercury switches, pneumatic valves and electrical wiring can all fail over time, endangering people and property in the area of the distributor bar. This is particularly true where, as in prior systems, a fluid control circuit is activated by switching to ground potential. A short circuit upstream of the switch can then cause spray valves to be activated erroneously.

In view of the harm that can result from failure of conventional fluid control circuits, especially when hot liquids are involved, it is desirable to eliminate any chance of inadvertently spraying liquid while the outer portions of the bar are in their retracted positions.

SUMMARY OF THE INVENTION

The present invention prevents liquid pavement material sprayed by certain portions of a distributor bar from reaching bystanders or adjacent property, even if a fluid control system associated with those portions malfunctions. This is accomplished by physically blocking the path of sprayed liquid whenever a group of nozzles is out of its normal operating position. A pan-like shield or similar structure is moved from a first position, in which nozzles of the group are exposed for spraying, and a second position, in which the nozzles are covered to block the flow of fluid from them. The shield is controlled in accordance with the position of the affected portion of the distributor bar and returns to the first position when it is no longer needed.

In a preferred embodiment, the flow of fluid to the nozzles on a movable portion of the bar is separately controlled by a device that either automatically or manually shuts off the flow when the movable portion pivots upwardly to a retracted, vertical position. In this context, the shield of the invention serves as an effective safety mechanism to protect persons and property in case the system malfunctions by spraying liquid from nozzles in the retracted position. The system is simple in structure, yet extremely reliable. It can be installed easily and inexpensively on existing commercial pavement sprayers.

Accordingly, a pavement sprayer of the present invention includes: a sprayer mechanism having at least one portion movable between an operative position for spraying paving material and a retracted, inoperative position; at least one blocking member mounted to the sprayer mechanism for movement between a blocking position in which any spray emanating from the movable portion is at least partially blocked and a nonblocking position in which the spray emanating from the movable portion is not blocked; and at least one blocking control for actuating the blocking member between the blocking and nonblocking positions in response to movement of the movable portions between their operative and retracted positions. In a preferred embodiment, a sensor senses the position of the retractable sprayer portion and sends a signal to an actuator that moves the blocking member between the blocking and non-blocking positions.

BRIEF DESCRIPTION OF THE DRAWINGS

The above and other features of the present invention may be more fully understood from the following detailed description, taken together with the accompanying drawings, wherein similar reference characters refer to similar elements throughout and in which:

FIG. 3 is a rear elevational view of the pavement sprayer of FIG. 1 with its bar portion shown in different angular positions;

FIG. 4 is a side elevational view of one of the spray blocking members of the present invention taken along the line 4—4 of FIG. 3, the spray blocking member being shown in its non-blocking position in phantom lines;

DESCRIPTION OF THE PREFERRED EMBODIMENTS

Figure 1:
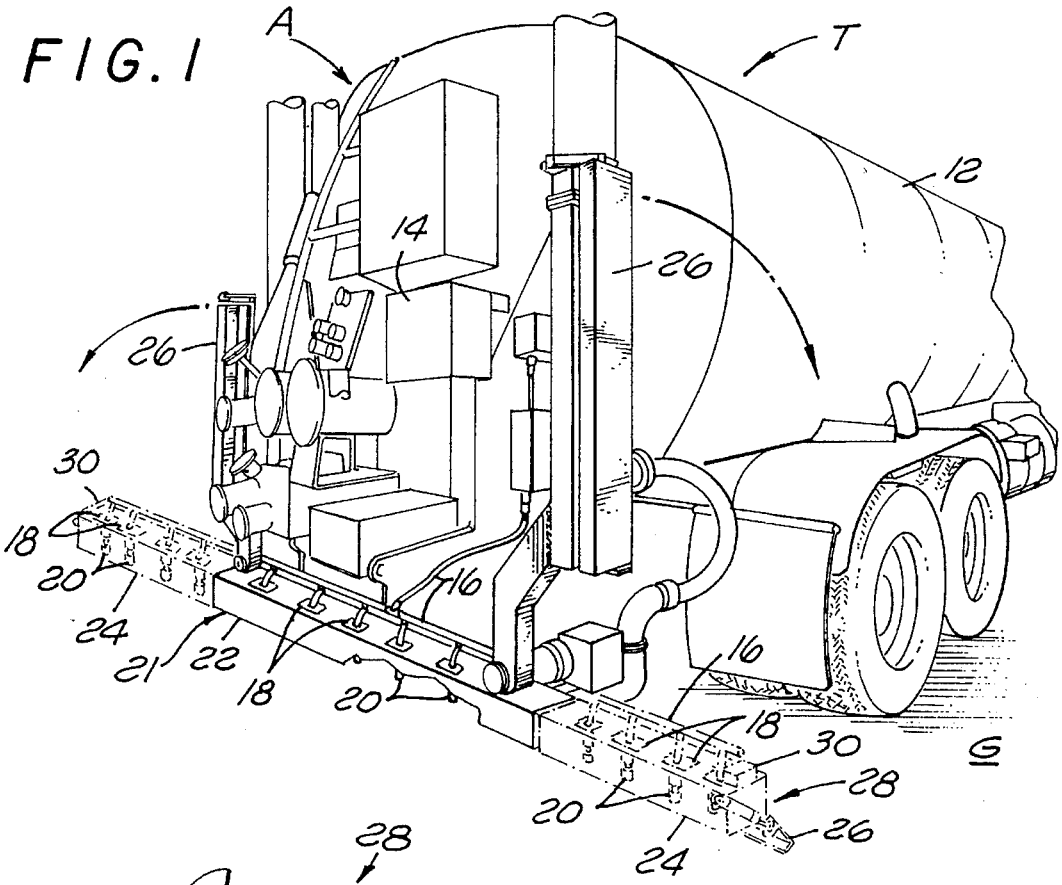
FIG. 1 is a fragmentary perspective view of a pavement sprayer incorporating a movable spray guard in accordance with the teachings of one embodiment of the present invention, the movable bar segments being shown in their operative positions in phantom lines.

Referring now to FIG. 1, one embodiment of a pavement sprayer A having a movable spray blocking member is mounted to the rear of a distributor vehicle, such as a truck or trailer T. In this embodiment, a heated paving composition is stored in a tank 12 and pressurized by a pump 14. The pressurized composition passes through one or more hoses 16 to valves 18 that control its flow to nozzles 20. The heated paving material is selectively sprayed onto a ground surface G through the nozzles 20 as the truck moves.

The nozzles 20 are mounted to a distributor bar 21 made up of a main portion 22 and two secondary or "side" portions 24. Each of the two side portions 24 is mounted for pivotal movement between a horizontal "operative" position, shown in phantom lines in FIG. 1, and a substantially vertical "retracted" position, shown in full lines. They are placed in their operative positions when a relatively wide portion of the ground surface G is being treated and are raised to their retracted positions when the treated areas is narrower or the truck T is transported between paving jobs. The valves 18 of the side portions 24 are intended to be closed in the retracted position to prevent the flow of paving material to the nozzles associated with the side portions.

Figure 2:
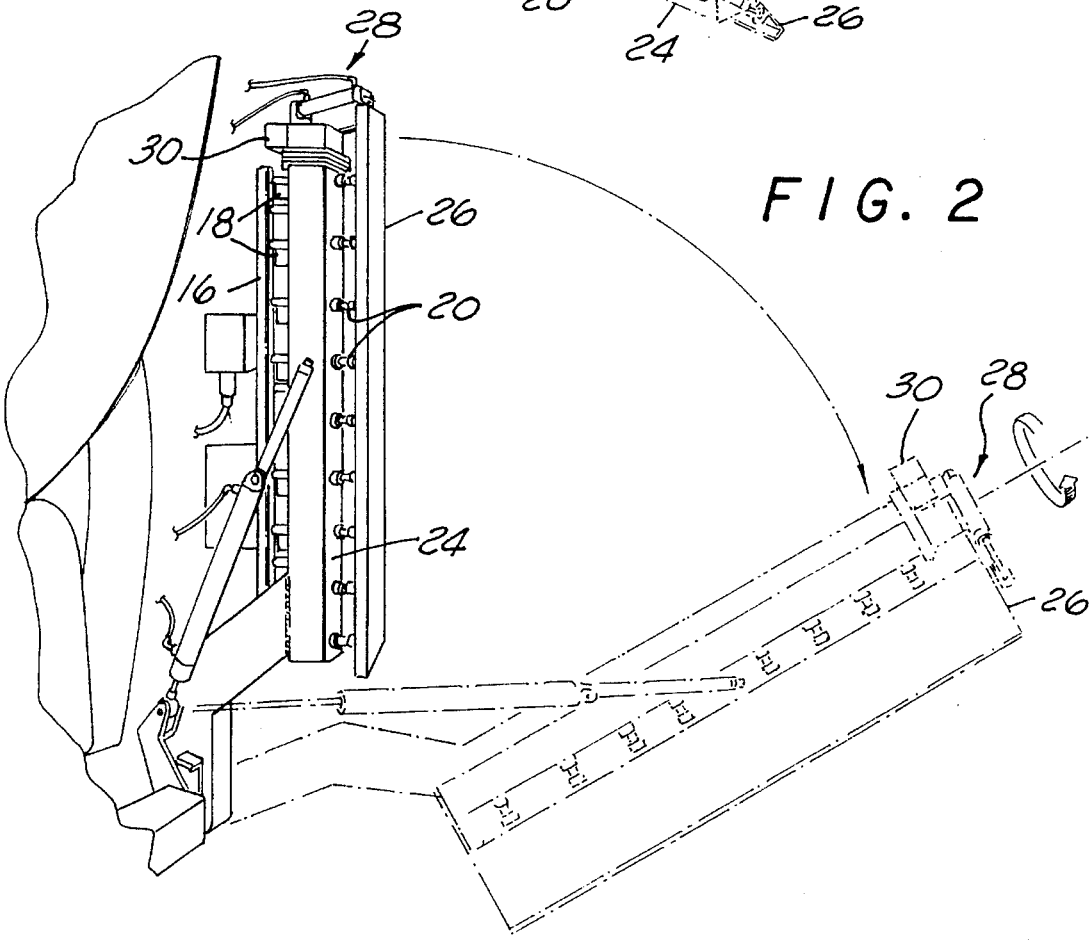
FIG. 2 is a fragmentary rear elevational view of the sprayer of FIG. 1 with its right bar portion retracted, the right bar portion also being illustrated in phantom lines at a point intermediate its retracted and operative positions.

In the event the supply of paving material to one of the side portions is inadvertently continued after the side portion is retracted, whether due to operator error or a failure of existing control mechanisms, the system of the present invention physically blocks the spray emanating from the affected nozzles. This eliminates the danger of persons or property being sprayed by nozzles directed away from the ground surface. As shown in FIG. 2, a spray blocking member or "shroud" 26 mounted to the side portion 24 blocks the path of spray from the associated nozzles 20 when the spray arm 24 is in its retracted position. The spray blocking member 26 subsequently moves out of the spray path when the spray arm 24 is moved to its horizontal, operative position.

The spray blocking member 26 is moved between its two positions by an actuator 28 in accordance with the sensed position of the side portion 24. When the side portion pivots upwardly to its retracted position, a sensor 30 mounted to the side portion signals the actuator by opening its control circuit. This causes the actuator to move the spray blocking member 26 to a position covering the nozzles 20 of that side portion and obstructing the path of any spray emanating from them. When the side portion 24 is lowered to its horizontal, operative position, the sensor control circuit opens, causing the actuator 28 to move the spray blocking member 26 out of the spray path automatically.

Referring again to FIG. 1, the paving composition to be sprayed is normally heated before it is placed in the tank 12 of the truck T and continues to be heated while in the tank to maintain a required spraying temperature. One useful paving composition is a combination of asphalt oil and recycled rubber formed into a jellied mixture and applied at a temperature of approximately 400° F. It is typically sprayed from the distributor bar 21 under a pressure of approximately 100 pounds per square inch (psi).

The flow control valves 18 referred to above control the flow of paving material to the nozzles 20. In a typical configuration, a plurality of such valves regulate the flow of paving material to a plurality of different groups of the nozzles 20. For example, the flow to the nozzles 20 on one of the side portions 24 is typically controlled by one set of valves 18, while the flow to nozzles on the main bar portion 22 and the other side portion 24 are regulated by different sets of valves 18. Thus, the flow of paving material to the nozzles 20 of the side portions 24 can be turned on and off independently of the flow to the other nozzles 20 of the sprayer A.

In the embodiment of FIGS. 1 and 3, the side portions 24 are aligned with the main portion 22 of the distributor bar 21 and extend outwardly from the vehicle in their horizontal, operative positions. When paving material leaves the nozzles 20, it is sprayed downwardly in a preselected pattern. Thus, the width of the overall spray pattern can be varied by selectively enabling and disabling the flow of paving material to the nozzles 20. When a relatively wide path is to be coated, all of the nozzles 20 are used. In contrast, only the nozzles on the main portion 22 are used if a relatively narrow stretch of pavement is to be coated. In the latter case, the side portions 24 are typically moved to their retracted positions to reduce the width of the sprayer A. The side portions then do not extend beyond the side of the truck, minimizing the possibility of collision as the truck moves.

Because the nozzles 20 on the side portions 24 face outwardly when the side portions are retracted, any accidental spraying of hot, pressurized paving material poses a serious danger to bystanders or property. This danger is eliminated by the spray blocking members 26 which prevent accidental spraying from the side portions while they are retracted. The apparatus blocks any inadvertent spraying in the event the flow of paving material is not turned off due, for example, to an operator forgetting to do so or the failure of an automatic sensing circuit.

As one of the side portions 24 moves between its operative and retracted positions, the sensor 30 senses the position of the side portion relative to a reference. In one embodiment, the reference is a horizontal plane and the sensor 30 is a mercury switch or similar device for sensing the angular orientation of the side portion relative to the horizontal plane. In another embodiment, the sensor is a proximity detector, such as a microswitch actuated by respective portions of the distributor bar as they move into close proximity to one another.

Referring now to FIG. 4, the blocking member 26 of one embodiment of the invention comprises a pan-like shield hinged to each side portion 24 of the distributor bar. The shield preferably has a substantially planar portion 31 for blocking the primary spray from the nozzles 20 and a down-turned edge portion 32 for further enclosing the blocked liquid. When one of the side portions is in its retracted position, as shown in full lines in FIG. 1, the sensor 30 signals its actuator 28 to swing the blocking member 26 toward the nozzle 20 and thereby intercept the output of the nozzles 20. When the side portions 24 move to their operative positions, shown in phantom lines in FIG. 1, the sensors 30 signal the actuators 28 to pivot the blocking member 26 away from the nozzles 20, allowing the nozzles to spray paving material onto the ground surface G.

Figure 5A:
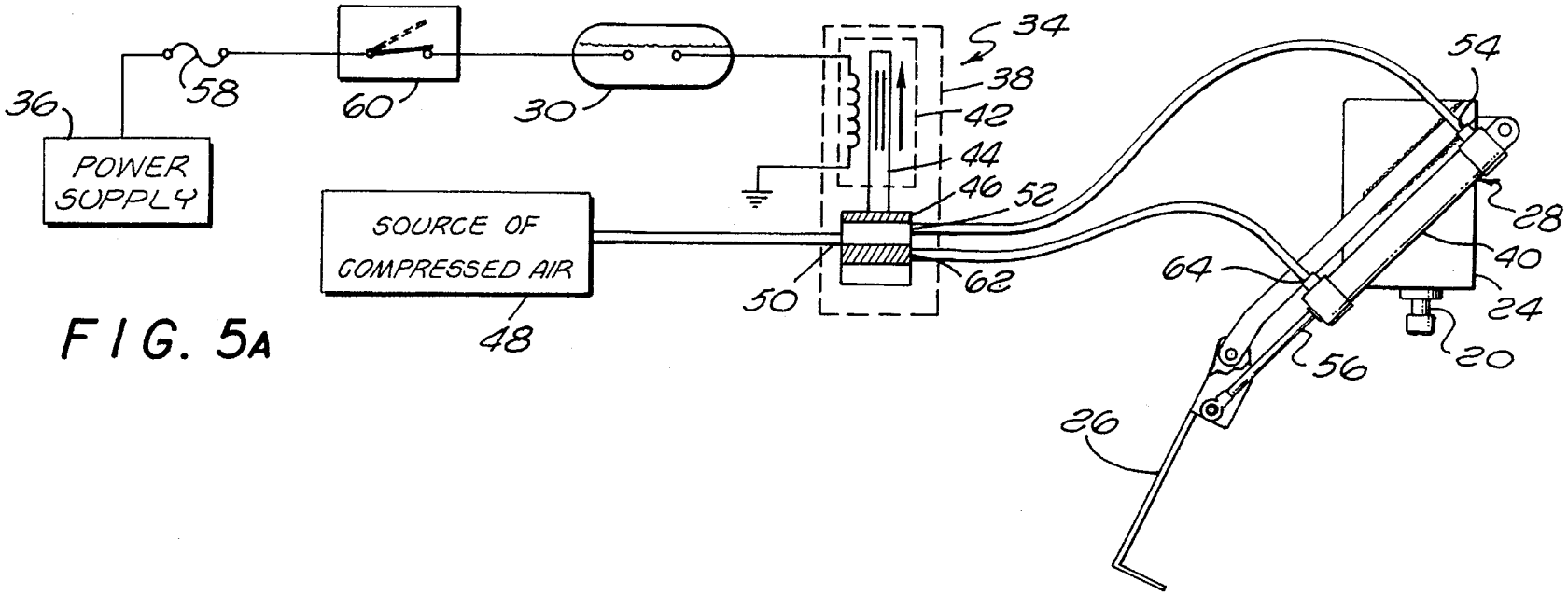
FIG. 5A is a schematic diagram of a blocking member control system constructed in accordance with one specific embodiment of the invention and showing the blocking member in its non-blocking position.
Figure 5B:
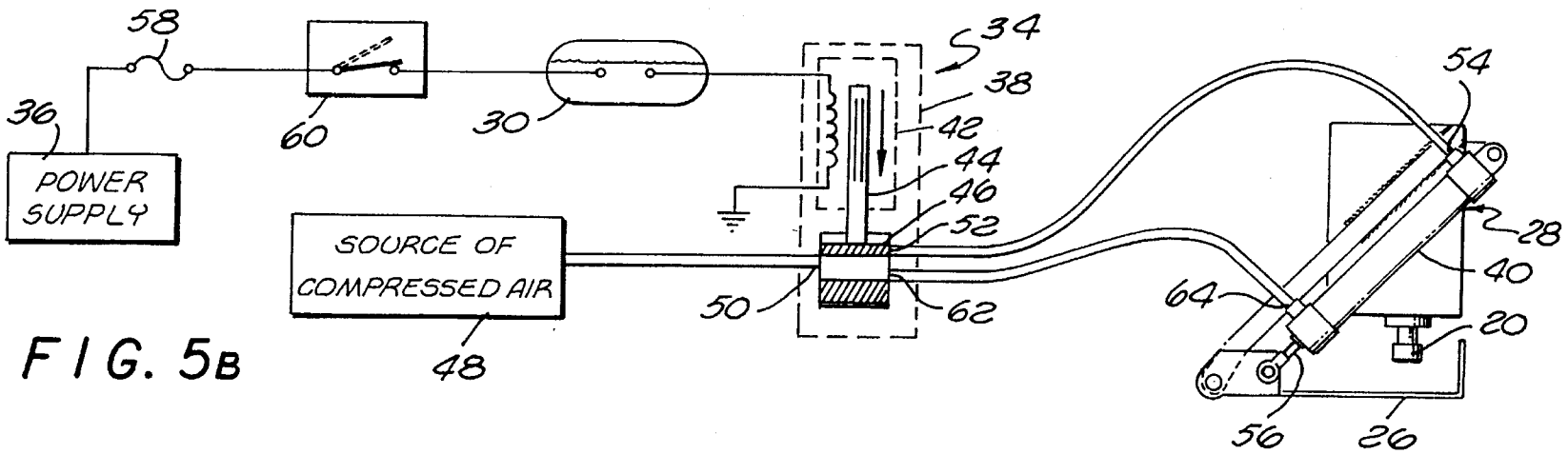
FIG. 5B is a schematic diagram of a blocking member control system constructed in accordance with one specific embodiment of the invention and showing the blocking member in its blocking position.

Referring now to FIGS. 5A and 5B, one embodiment of the present invention utilizes a hybrid electrical and pneumatic circuit 34 to control the spray blocking member 26 (FIG. 2). In this embodiment, the sensor 30 takes the form of a simple mercury switch mounted to each side portion 24 of the distributor bar (FIGS. 2 and 3) to sense its position. The mercury switch opens and closes its contacts based on the orientation of the side portion 24 relative to the horizontal. The switch is preferably mounted so that its contacts are closed when the side portion 24 is in the horizontal, operative position, and open when the side portion 24 moves upwardly toward its retracted position to a point at which it forms a preselected critical angle with the horizontal. The critical angle typically is between 25 and 65 degrees, and preferably is approximately 45 degrees.

In the electrical and pneumatic circuit 34, the mercury switch of the sensor 30 switches a supply voltage from a power supply 36 to control the actuator 28. In the illustrated embodiment, the actuator 28 is made up of an electrically-controlled fluid valve 38 in combination with a piston-and-cylinder arrangement 40 which moves the spray blocking member 26. The voltage applied through the mercury switch energizes a solenoid 42 of the fluid valve 38 to draw a plunger 44 and a valve element 46 upwardly to the position illustrated in FIG. 5A. In this position, which corresponds to the operative position of the associated side portion 24, compressed air supplied by a source 48 to an inlet port 50 of the fluid valve is directed through a first outlet port 52 to an extension port 54 of the piston-and-cylinder arrangement. This extends the piston rod 56 to the position illustrated in FIG. 5A, thereby pivoting the blocking member 26 to the nonblocking position shown in phantom lines in FIG. 4. In this position, liquid emanating from the nozzles 40 is free to continue in a downward direction toward the ground surface G (FIG. 1).

The hybrid electrical and pneumatic circuit 34 is designed so that each of the blocking members can be in its nonblocking position only when all elements of the circuit 34 are operational and the side portion 24 is in its horizontal, operative position. A fuse 58 in series with the mercury sensor 30 protects the control circuit, and one or more control switches 60 permit manual activation of the blocking member 26. The circuit 34 operates to move the shroud to the unblocked condition only if the fuse 58 is intact and the control switch(es) 60 are closed. Likewise, the mercury switch of the sensor 30 must be in its closed condition, which is true only when the side portion 24 is elevated from the horizontal by no more than approximately 45 degrees.

Any movement of the sensor 30 beyond its critical angle, or any other failure in the supply circuitry, deactivates the solenoid 42. The valve element then falls to the position of FIG. 5B, in which pressurized air applied to the inlet port 50 exits the fluid valve through an outlet port 62 and is applied to a return port 64 of the piston and cylinder arrangement 38. This draws the piston rod 56 upwardly, pulling the blocking member 26 into the blocking position of FIG. 5B. The electrically-controlled fluid valve 38 is biased toward the position of FIG. 5B to maintain the blocking member 26 in its blocking position whenever the solenoid 42 is not energized. The blocking member 26 therefore acts as a fail-safe device to physically intercept the spray of paving material from the nozzles on the side portions 24 (FIGS. 1–3) anytime the side portions are elevated beyond their critical angles.

The components of the hybrid electrical and pneumatic system 34 can be varied significantly without departing from the scope of the present invention. In the specific embodiment of FIGS. 5A and 5B, however, the fluid valve 38 is preferably a conventional solenoid-actuated valve capable of operating in response to a DC voltage, typically 12 volts, and controlling compressed air at pressures of at least approximately 100 pounds per square inch. In one form of the invention, the fluid valves 38 are of the type available commercially from Automatic Valve Corporation of Novi, Michigan under part number 1070ZAAWR-DA. Similarly, the mercury switch of the sensor 30 can be any commercially available mercury switch capable of operating at the rated voltage of the supply circuit and switching from a closed circuit condition to a open circuit condition within the required angular range of approximately 45 degrees. Such a device is available from Mercury Switch Company of Elkhart, Ind. as part number AS417B. Similarly, the pneumatic piston-and-cylinder arrangement 40 may be of the type available commercially from Bimba Manufacturing Company of Monee, Ill. as part number 093-DP. In most cases, the power supply 36 will be part of the 12-volt DC power system of the vehicle T to which the apparatus A is mounted.

In operation, the apparatus A is transported to a job site in a conventional manner with the side portions 24 of the distributor bar 21 in their vertical, retracted positions. The blocking member 26 is then in its blocking position, as illustrated in FIG. 5B and in full lines in FIG. 4, because the mercury switch of the sensor 30 forms an open circuit. The control switch 60 is also open because paving material is not being sprayed.

When the truck T reaches the job site and spraying is begun, the control switch 60 is closed. Assuming the power supply 36, the fuse 58, and the compressed air source 48 are all operational, the position of the blocking member 26 depends on whether the side portions 24 of the distributor bar are in their retracted positions, as shown in full lines in FIG. 1, or their operative positions, as shown in phantom lines. The side portions are left in their retracted positions when relatively narrow strips of pavement are to be sprayed and are moved to their operative positions only when a wider spray pattern is desired. In the retracted position, the mercury switch of the sensor 30 is open, maintaining the fluid valve 38 in its deenergized condition. The fluid valve then connects the compressed air supply 48 to the return port 64 of the piston-and-cylinder arrangement 40, maintaining the blocking member 26 in the blocking position of FIG. 5B. This prevents any spray that might be released inadvertently from the nozzles 20 of the side portions 24 from reaching persons or property near the truck. Although a separate safety system (not shown) is provided to shut off the flow of fluid to any side portion more than 45 degrees from its operative position, such systems have been known to fail. If they do, the system of the present invention will nevertheless act to avoid serious harm.

When one of the side portions 24 is moved to its operative position,the mercury switch of the associated sensor 30 closes. If the fuse 58 is intact and the control switch 60 is closed, as well, the fluid valve 38 is activated (FIG. 5A) to drive the blocking member 26 to its nonblocking position. Spray emanating from the nozzles 20 of the side portion is then free to pass downwardly to the ground surface G.

It will be understood that the hybrid electrical and pneumatic control circuit 34 is specifically designed to return the blocking member 26 to the blocking position of FIG. 5B if any portion of the circuit malfunctions. Thus, a failure of the power supply 36, the fuse 58, the control switch 60, the mercury switch of the sensor 30 or the solenoid 42 will cause the fluid valve 38 to assume its normal position, illustrated in FIG. 5B, activating the piston and cylinder arrangement 40 to draw the blocking member into position.

From the above, it can be seen that the present invention provides a simple and reliable method of preventing unwanted spraying from nozzles of a spray arm retracted from its normal operating position.

While certain specific embodiments of the invention are disclosed as typical, the invention is not limited to these particular forms, but rather is applicable broadly to all such variations as fall within the scope of the appended claims. For example, a wide variety of sensors including mechanical, electro-mechanical or electrical devices can be used to sense whether the side portions of the distributor bar are in their retracted positions. Similarly, an entirely electrical or mechanical system can be used to drive the actuators, and the actuators themselves can be implemented using non-pneumatic devices, including motors, electromagnets or mechanical levers. In addition, an effective spray blocking member can be constructed in any number of different shapes and using a variety of retracting mechanisms. Furthermore, a variety of fail-safe mechanisms can be used, including return springs to automatically return the spray blocking members to their blocking positions in case the actuating mechanism malfunctions. Thus, the specific structures discussed in detail above are merely illustrative of a few specific embodiments of the invention.

What is claimed is:

1. A pavement sprayer having a movable spray guard comprising:

a sprayer mechanism capable of applying liquid to a pavement surface as a spray, said sprayer mechanism having at least one portion movable between an operative position for spraying the pavement surface and a retracted, inoperative position;

at least one blocking member mounted to the sprayer mechanism for movement between a blocking position, in which any spray emanating from the movable portion is at least partially blocked, and a non-blocking position, in which the spray emanating from the movable portion is not blocked; and at least one blocking control for actuating the blocking member between said blocking and non-blocking positions in response to movement of the movable portion of the sprayer mechanism between said operative and retracted positions.

2. A pavement sprayer having a movable spray guard comprising:

a sprayer mechanism mountable to a vehicle and capable of applying liquid to a pavement surface as a spray, said sprayer mechanism having a main portion and a secondary portion movable relative to the main portion, the secondary portion being movable between an operative position for spraying the pavement surface and a retracted, inoperative position;

at least one blocking member mounted to the secondary portion for movement between a blocking position, in which any spray emanating from the secondary portion is at least partially blocked, and a non-blocking position, in which spray emanating from the secondary portion is not blocked; and at least one blocking control for actuating the blocking member between said blocking and non-blocking positions in response to movement of the secondary portion.

3. The pavement sprayer of claim 2 wherein:

said blocking control comprises at least one blocking actuator for moving the blocking member between said blocking and non-blocking positions in response to movement of the secondary portion.

4. The pavement sprayer of claim 3 wherein:

said blocking control comprises at least one position sensor for sensing the position of said secondary portion and causing the blocking actuator to place the blocking member in the blocking position when the secondary portion is in its retracted, inoperative position.

5. The pavement sprayer of claim 4 wherein:

said blocking actuator comprises at least one fluid cylinder.

6. The pavement sprayer of claim 4 wherein:

said blocking actuator comprises at least one fluid valve.

7. The pavement sprayer of claim 4 wherein:

said position sensor comprises at least one mercury switch.

8. The pavement sprayer of claim 4 wherein:

the operative position of said secondary portion is substantially horizontal; and the position sensor signals the blocking actuator that the secondary portion is in its retracted position when the secondary portion forms at least a preselected angle with respect to the horizontal.

9. The pavement sprayer of claim 8 wherein: said preselected angle is substantially 45 degrees.

10. The pavement sprayer of claim 2 wherein:

said sprayer mechanism comprises a plurality of nozzles for directing the spray onto the pavement surface.

11. The pavement sprayer of claim 10 wherein:

said secondary portion is pivotally attached to said main portion.

12. The pavement sprayer of claim 10 wherein:

said blocking member is pivotally attached to said secondary portion.

13. The pavement sprayer of claim 2 wherein:

said blocking member comprises a plate-like shield.

14. A pavement sprayer having a movable spray guard comprising:

a source of pressurized liquid paving material;

a sprayer mechanism mountable to a vehicle to receive said liquid paving material and apply it to a pavement surface as a spray, said sprayer mechanism having a main portion and a secondary portion movable relative to the main portion, said secondary portion being movable between an operative position for spraying the pavement surface and a retracted, inoperative position;

at least one fluid valve for stopping the flow of said liquid paving material to said secondary portion when said secondary portion is in its retracted, inoperative position;

at least one blocking member mounted to said secondary portion for movement between a blocking position, in which any spray emanating from the secondary portion is at least partially blocked, and a non-blocking position, in which spray emanating from the secondary portion is not blocked; and at least one blocking control which moves the blocking member to said blocking position when said secondary portion is in its retracted, inoperative position.

15. The pavement sprayer of claim 14 which further comprises:

a first mercury switch for sensing when said secondary portion is in its retracted, inoperative position; and said at least one fluid valve operates in response to said first mercury switch.

16. The pavement sprayer of claim 15 wherein:

said at least one blocking control includes a second mercury switch for sensing when said secondary portion is in its retracted, inoperative position and controlling the movement of the blocking member.

17. A pavement sprayer having a movable spray guard comprising:

a source of pressurized liquid paving material;

a sprayer mechanism mountable to a vehicle to receive said liquid paving material and apply it to a pavement surface as a spray, said sprayer mechanism having a main portion fixedly attached to said vehicle and a secondary portion movable relative to the main portion, said secondary portion being movable between an operative position for spraying the pavement surface and a retracted, inoperative position;

at least one blocking member mounted to said secondary portion for movement between a blocking position, in which any spray emanating from the secondary portion is at least partially blocked, and a non-blocking position, in which spray emanating from the secondary portion is not blocked; and at least one blocking control which senses the position of said secondary portion and actuates the movement of said blocking member between the non-blocking and blocking positions in response to said sensed position.

18. The pavement sprayer of claim 17 wherein:

said blocking member comprises a plate-like shield.

19. The pavement sprayer of claim 18 wherein:

said plate-like shield is mounted to said secondary member for pivotal movement between said blocking and nonblocking positions.

20. The pavement sprayer of claim 17 wherein said blocking control comprises:

a drive unit mounted between said secondary portion and said blocking member to move said blocking member between its blocking and non-blocking positions; and a sensor detecting when said secondary portion is in its retracted, inoperative position and generating a signal in response thereto.

21. The pavement sprayer of claim 20 wherein:

said drive unit comprises a pneumatic actuator.

22. The pavement sprayer of claim 21 wherein:

said sensor comprises a mercury switch.

* * * * *